US006599866B2

(12) United States Patent
Poirier

(10) Patent No.: US 6,599,866 B2
(45) Date of Patent: Jul. 29, 2003

(54) SERVO VALVE EROSION INHIBITED AIRCRAFT HYDRAULIC FLUIDS

(75) Inventor: Marc-André Poirier, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/077,606

(22) Filed: Feb. 15, 2002

(65) Prior Publication Data

US 2002/0179883 A1 Dec. 5, 2002

Related U.S. Application Data

(60) Provisional application No. 60/285,109, filed on Apr. 20, 2001.

(51) Int. Cl.[7] ..... C10M 105/74; C10M 135/10; C09K 5/00

(52) U.S. Cl. ..... 508/406; 508/410; 508/421; 252/78.5

(58) Field of Search ..... 252/78.5; 508/406, 508/410, 421; 558/48, 56

(56) References Cited

U.S. PATENT DOCUMENTS

| | | | | |
|---|---|---|---|---|
| 2,732,398 A | | 1/1956 | Brice et al. | 260/503 |
| 3,346,613 A | | 10/1967 | Larson et al. | 260/456 |
| 3,490,737 A | | 1/1970 | Gieseking et al. | 252/25 |
| 3,679,587 A | | 7/1972 | Smith | 252/75 |
| 3,707,501 A | | 12/1972 | Gentit et al. | 252/78 |
| 3,723,320 A | | 3/1973 | Herber et al. | 252/78 |
| 3,882,238 A | | 5/1975 | Quackenbush et al. | 424/303 |
| 3,914,272 A | | 10/1975 | Starks et al. | 260/456 P |
| 3,940,366 A | | 2/1976 | Mark | 260/45.9 R |
| 4,252,662 A | | 2/1981 | Marolewski et al. | 252/78.5 |
| 4,324,674 A | | 4/1982 | MacKinnon | 252/78.5 |
| 4,461,713 A | | 7/1984 | Anzenberger | 252/49.9 |
| 5,464,551 A | * | 11/1995 | Deetman | 252/78.5 |
| 5,550,277 A | | 8/1996 | Paciorek et al. | 558/194 |
| 6,254,799 B1 | | 7/2001 | Antika et al. | 252/78.5 |
| 6,316,484 B1 | | 11/2001 | Flygare et al. | 514/403 |
| 6,319,423 B1 | | 11/2001 | Okazaki et al. | 252/78.5 |
| 6,391,225 B1 | | 5/2002 | Poirier | 252/78.5 |

FOREIGN PATENT DOCUMENTS

| | | | |
|---|---|---|---|
| WO | WO 0061698 | 10/2000 | C09K/5/04 |

* cited by examiner

*Primary Examiner*—Ellen M. McAvoy
(74) *Attorney, Agent, or Firm*—Estelle C. Bakun

(57) ABSTRACT

The incorporation of a minor amount of a salt of pentafluorobenzene sulfonic acid to phosphate ester based functional fluids enhances the anti-erosion properties of the fluid.

6 Claims, No Drawings

SERVO VALVE EROSION INHIBITED AIRCRAFT HYDRAULIC FLUIDS

This application claims the benefit of U.S. Provisional Application No.: 60/285,109 filed Apr. 20, 2001

FIELD OF THE INVENTION

This invention relates to phosphate ester fluids used in transmitting power in hydraulic systems. More specifically it relates to enhancing the anti-erosion properties of such fluids.

BACKGROUND OF THE INVENTION

Functional fluids are used in a wide variety of industrial applications. For example they are used as the power transmitting medium in hydraulic systems, such as aircraft hydraulic systems.

Functional fluids intended for use in aircraft hydraulic systems must meet stringent performance criteria such as thermal stability, fire resistance, low susceptibility to viscosity changes over a wide range of temperatures, good hydrolytic stability, elastomer compatibility and good lubricity.

Organic phosphate ester fluids have been recognized as a preferred fluid for use as a functional fluid such as in hydraulic fluids. Indeed, in present commercial aircraft hydraulic fluids phosphate esters are among the most commonly used base stocks.

As with other functional fluids, organic phosphate ester based fluids require the incorporation of various additives to enhance the performance of the fluid. For example, experience has shown that orifices in the servo control valves of aircraft hydraulic systems are subject to erosion which is attributed to streaming current induced by fluid flow. Valve orifice erosion, if extensive, can greatly impair the functioning of the valve as a precise control mechanism. Therefore various additives have been used in functional fluids as erosion inhibitors. Nonetheless, there remains a need for increased choice of useful erosion inhibitors, especially for improved erosion inhibitors.

One object of the present invention is to provide phosphate ester based aircraft hydraulic fluids with enhanced anti-erosion properties.

SUMMARY OF THE INVENTION

It has now been found that salts of pentafluorobenzene sulfonic acid when incorporated into phosphate ester based functional fluids serve to provide the fluid with anti-erosion properties. Specifically phosphate ester based functional fluids are enhanced by incorporating in the fluid an effective amount of the salt, preferably an alkali-metal or quaternary ammonium salt, of pentafluorobenzene sulfonic acid and mixtures thereof.

DETAILED DESCRIPTION OF THE INVENTION

The anti-erosion properties of phosphate ester based functional fluids, especially aircraft hydraulic fluids, are enhanced by adding to the fluid an effective amount of a salt or mixture of salts of pentafluorobenzene sulfonic acid. These salts can be represented by the formula

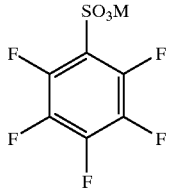

where M is an alkali metal, or a quaternary ammonium group represented by the formula R, R', R", R'", $N^{\oplus}$ where R, R', R", and R'" are independently hydrogen, hydrocarbyl groups of from 1 to 30 carbon atoms, and oxygen containing hydrocarbyl groups of 2 to 30 carbon atoms.

The foregoing alkali metal salts are readily prepared by neutralization of pentafluorobenzene sulfonic acid with an alkali metal hydroxide or by reacting pentafluorobenzene sulfonyl chloride with an alkali metal hydroxide.

Similarly, the ammonium salts are readily prepared by neutralization of the pentafluorobenzene sulfonic acid with the ammonium hydroxide or by reacting the pentafluorobenzenesulfonic acid with an amine.

Phosphate ester base stocks used in this invention refer to organo-phosphate esters selected from trialkyl phosphate, dialkyl aryl phosphate, alkyl diaryl phosphate and triaryl phosphate that contain from 3 to 8, preferably from 4 to 5 carbon atoms. Suitable phosphate esters useful in the present invention include, for example, tri-n-butyl phosphate, tri-isobutyl phosphate, n-butyl di-isobutyl phosphate, di-isobutyl n-butyl phosphate, n-butyl diphenyl phosphate, isobutyl diphenyl phosphate, di-n-butyl phenyl phosphate, di-isobutyl phenyl phosphate, tri-n-pentyl phosphate, tri-isopentyl phosphate, triphenyl phosphate, isopropylated triphenyl phosphates, and butylated triphenyl phosphates. Preferably, the trialkyl phosphate esters are those of tri-n-butyl phosphate and tri-isobutyl phosphate.

The amounts of each type of phosphate ester in the hydraulic fluid can vary depending upon the type of phosphate ester involved. The amount of trialkyl phosphate in the base stock fluid comprises from about 10 wt % to about 100 wt % preferably from about 20 wt % to about 90 wt %. The amount of dialkyl aryl phosphate in the base stock fluid is typically from 0 wt % to 75 wt % preferably from 0 wt % to about 50 wt %. The amount of alkyl diaryl phosphate in the base stock fluid is typically from 0 wt % to 30 wt %, preferably from 0 wt % to 10 wt %. The amount of triaryl phosphate in the base stock fluid is typically from 0 wt % to 20 wt % and preferably from 0 wt % to 15 wt %.

The hydraulic fluids of this invention contain from 1 wt % to 20 wt % based on total weight composition of additives selected from one or more antioxidants, acid scavengers, VI improvers, rust inhibitors, defoamers. The use of those conventional additives provides satisfactory hydrolytic, oxidative stability and viscosmetric properties of the hydraulic fluid compositions under normal and severe conditions found in aircraft hydraulic systems.

Antioxidants useful in hydraulic fluid compositions in this invention include, for example, polyphenols, trialkylphenols and di (alkylphenyl) amines, examples of which include bis (3,5-di-tert-butyl-4-hydroxyphenyl) methane, 1,3,5-trimethyl-2,4,6-tris (3,5-di-tert-butyl-4-hydroxyphenyl) benzene, 2,6-di-tert-butyl-4-methylphenol, tetrakis (methylene (3,5-di-tert-butyl-4-hydroxy-hydrocinnamate) methane, and di (n-octylphenyl) amine. Typical amounts for each type of antioxidants can be from about 0.1 wt % to 2 wt %.

Acid scavengers useful in hydraulic fluid compositions of this invention to neutralize phosphoric acid and dialkyl phosphoric acid produced from the hydrolysis and thermal degradation of the phosphate ester base stocks. Examples of acid scavengers include epoxy compounds such as epoxycyclohexane carboxylates. Typical amounts that can be used as acid scavenger can be from about 1 to about 10 wt % based on the total weight of hydraulic fluid.

The pentafluorobenzene sulfonic acid salts used in the foregoing fluid formulations is an amount sufficient to enhance the anti-erosion properties of the fluid. Typically the salt will comprise about 0.01 wt % to about 0.5 wt % based on the weight of the ester basestock.

EXAMPLE 1

A mixture of pentafluorobenzenesulfonyl chloride (25.0 g, 94 mmoles) and potassium hydroxide (86% purity, 12.3 g, 188 mmoles) was dissolved in 230 ml water and stirred at room temperature for 18 hours. The produced precipitate was filtered off and recrystallized from water (about 6 ml/g product). Colorless needles formed were filtered, washed with cool water and ethanol and dried in a vacuum oven for 24 hours to yield 22.1 g of potassium pentafluorobenzene sulfonate (82% yield).

EXAMPLE 2

This example is presented to hypothetically illustrate making functional fluids containing an alkali metal salt of pentafluorobenzene sulfonic acid. The following functional fluids can be prepared by incorporating the particular salt into a tributyl phosphate, trialylphosphate base oil containing conventional VI improver, epoxide acid scavenger, antioxidant rust inhibitor and difoamer.

TABLE 1

| Fluid | Salt of Pentafluoro Sulfonic Acid | Concentration, wt % |
|---|---|---|
| 1 | Potassium | 0.01 |
| 2 | Lithium | 0.5 |
| 3 | Rubidium | 0.01 |
| 4 | Cesium | 0.01 |
| 5 | Potassium | 0.5 |

TABLE 1-continued

| Fluid | Salt of Pentafluoro Sulfonic Acid | Concentration, wt % |
|---|---|---|
| 6 | Lithium | 0.1 |
| 7 | Quaternaryammonium | 0.05 |

What is claimed is:

1. A functional fluid comprising a phosphate ester basestock and a salt or mixture of salts of pentafluorobenzene sulfonic acid in an amount sufficient to enhance the anti-erosion properties of the fluid.

2. The fluid of claim 1 wherein the salt or mixture thereof is represented by the formula

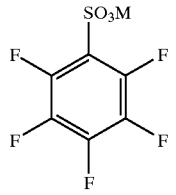

where M is an alkali metal or a quaternary ammonium group represented by the formula RR'R'''N⊕, where R, R', R'', and R''' are independently hydrogen, hydrocarbyl groups of 1 to 30 carbon atoms and oxygen containing hydrocarbyl groups of 2 to 30 carbon atoms.

3. The fluid of claim 2 wherein the salt or mixture of salts comprises about 0.01 to about 0.5 wt % based on the weight of the basestock.

4. The fluid of claim 3 wherein M is an alkali metal.

5. The method of inhibiting the erosion tendency of a phosphate ester based functional fluid comprising adding to the fluid from 0.01 to 0.5 wt % of an alkali metal or quaternary ammonium salt, of pentafluorobenzene sulfonic acid or mixtures thereof to the fluid.

6. The method of claim 5 wherein the salt is an alkali metal salt.

* * * * *